US007528803B2

(12) United States Patent
Lee et al.

(10) Patent No.: US 7,528,803 B2
(45) Date of Patent: May 5, 2009

(54) PLASMA DISPLAY PANEL DRIVER AND PLASMA DISPLAY DEVICE

(75) Inventors: Jun-Young Lee, Suwon-si (KR); Nam-Sung Jung, Suwon-si (KR); Dong-Young Lee, Suwon-si (KR); Byung-Nam An, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 707 days.

(21) Appl. No.: 10/923,690

(22) Filed: Aug. 24, 2004

(65) Prior Publication Data

US 2005/0057453 A1 Mar. 17, 2005

(30) Foreign Application Priority Data

Aug. 25, 2003 (KR) ..... 10-2003-0058736

(51) Int. Cl.
*G09G 3/28* (2006.01)

(52) U.S. Cl. ..... 345/62

(58) Field of Classification Search ..... 345/60–68, 345/41, 42; 315/169.3, 169.4
See application file for complete search history.

(56) References Cited

U.S. PATENT DOCUMENTS

| | | | | |
|---|---|---|---|---|
| 4,866,349 | A | 9/1989 | Weber et al. | 315/169.4 |
| 5,081,400 | A | 1/1992 | Weber et al. | 315/169.4 |
| 6,628,087 | B2 * | 9/2003 | Roh et al. | 345/60 |
| 6,781,322 | B2 * | 8/2004 | Onozawa et al. | 315/169.3 |
| 2002/0097237 | A1 * | 7/2002 | Tomio et al. | 345/211 |
| 2003/0025654 | A1 * | 2/2003 | Jin et al. | 345/60 |

FOREIGN PATENT DOCUMENTS

| | | |
|---|---|---|
| JP | 08-160901 | 6/1996 |
| JP | 2000-181401 | 6/2000 |
| JP | 2000-181404 | 6/2000 |
| JP | 2000-276105 | 10/2000 |
| JP | 2000-293135 | 10/2000 |
| JP | 2001-024491 | 1/2001 |
| JP | 2001-228821 | 8/2001 |
| JP | 2002-366095 | 12/2002 |
| JP | 2003-015600 | 1/2003 |
| JP | 2003-076323 | 3/2003 |
| JP | 2003-228318 | 8/2003 |
| KR | 2003-0034763 | 5/2003 |

* cited by examiner

*Primary Examiner*—Chanh Nguyen
*Assistant Examiner*—Allison Walthall
(74) *Attorney, Agent, or Firm*—H.C. Park & Associates, PLC

(57) ABSTRACT

Disclosed is a driver for a PDP including discharge cells with a plurality of electrodes, which may include the following: a first voltage source having a first voltage level; a first active element for intercepting a current flow in the direction of the first voltage source; a first switch coupled between the first active element and an electrode; a capacitor for storing a second voltage; and a second switch for supplying the second voltage stored in the capacitor to the electrode. The first active element and the first switch may each be transistors, and they may be coupled together, back-to-back.

20 Claims, 11 Drawing Sheets

PLASMA DISPLAY PANEL DRIVER AND PLASMA DISPLAY DEVICE

CROSS REFERENCE TO RELATED APPLICATION

This application claims priority to and the benefit of Korea Patent Application No. 2003-58736 filed on Aug. 25, 2003, in the Korean Intellectual Property Office, the entirety of which is incorporated herein by reference.

BACKGROUND OF THE INVENTION

1. Field of the Invention

The present invention relates to a plasma display panel (PDP) driving circuit. More specifically, the present invention relates to a driving circuit for preventing waveform distortion caused by impedance provided on a main discharge path.

2. Description of the Related Art

Recently, liquid crystal displays (LCDs), field emission displays (FEDs), and plasma displays have been actively developed. The plasma displays panels (PDPs) from among the flat panel devices may have better luminance and light emission efficiency compared to the other types of flat panel devices, and also may have wider view angles. Therefore, the plasma displays may be suitable substitutes for conventional cathode ray tubes (CRTs) in large displays of greater than 40 inches.

A PDP generally is a flat display that uses plasma generated via a gas discharge process to display characters or images, and tens to millions of pixels are provided thereon in a matrix format, depending on its size. The two general kinds of PDPs are AC PDPs and DC PDPs, based on their respective driving voltage waveforms.

Because DC plasma displays have electrodes exposed in the discharge space, they allow electric current to flow in the discharge space while voltage is supplied. Therefore they problematically require resistors for current restriction. On the other hand, because AC plasma displays have electrodes covered by a dielectric layer, capacitances are naturally formed to restrict the current. Accordingly, the electrodes are protected from ion shocks during discharge. Thus, they have a longer lifespan than DC plasma displays.

FIG. 1 shows a perspective view of an AC PDP. As shown, a scan electrode 4 and a sustain electrode 5, disposed over a dielectric layer 2 and a protection film 3, may be provided in parallel and may form a pair with each other under a first glass substrate 1. A plurality of address electrodes 8 covered with an insulation layer 7 may be installed on a second glass substrate 6. Barrier ribs 9 may be formed in parallel with the address electrodes 8, on the insulation layer 7 between the address electrodes 8. Phosphor 10 may be formed on the surface of the insulation layer 7 between the barrier ribs 9. The first and second glass substrates 1 and 6 having a discharge space 11 between them may be provided facing each other so that the scan electrode 4 and the sustain electrode 5 may respectively cross the address electrode 8. The address electrode 8 and a discharge space 11 formed at a crossing part of the scan electrode 4 and the sustain electrode 5 may form a discharge cell 12.

FIG. 2 shows a PDP electrode arrangement diagram. As shown, the PDP electrode has an m×n matrix configuration, and in detail, it has address electrodes A1 to Am in the column direction, and scan electrodes Y1 to Yn and sustain electrodes X1 to Xn in the row direction, alternately. For ease of identification, the scan electrodes will be noted as "Y electrodes" and the sustain electrodes as "X electrodes." The discharge cell 12 shown in FIG. 2 corresponds to the discharge cell 12 shown in FIG. 1.

FIG. 3 shows a PDP. As shown, the PDP comprises a plasma panel 10, an address driver 20, a scan/sustain driver 30, and a controller 40.

The plasma panel 10 comprises a plurality of address electrodes A1 to Am arranged in the column direction, and a plurality of scan electrodes Y1 to Yn and sustain electrodes X1 to Xn alternately arranged in the row direction.

The address driver 20 receives an address driving control signal from the controller 40, and applies display data signals for selecting discharge cells to be displayed to the respective address electrodes, and it comprises a power recovery circuit for recovering reactive power and reusing the same.

The scan/sustain driver 30 receives a sustain discharge signal from the controller 40, and alternately inputs sustain pulse voltages to the scan and sustain electrodes to thus perform a sustain discharge on the selected discharge cells.

The controller 40 receives external video signals, generates an address driving control signal and a sustain discharge signal, and respectively applies them to the address driver 20 and the scan/sustain driver 30.

FIG. 4 shows a conventional PDP driving circuit.

In general, the AC PDP is driven by a sustain period, an erase period, a reset period, and an address period, and the same is driven by using various waveforms.

The scan driving circuit comprises a power recovery circuit proposed by Weber disclosed in U.S. Pat. Nos. 4,866,349 and 5,081,400, a first ramp pulse supply 31, a second ramp pulse supply 32, and a scan voltage supply 33.

A conventional sustain discharge operation and a power recovery operation will be described.

A switch S4 is turned on before a switch S1 is turned on, and a voltage at a panel C2 is maintained at 0V. When the switch S1 is turned on, an LC resonance circuit is formed in the order of a capacitor C1 and the switch S1, and in the order of a diode D1, an inductor L1, and the panel C2, and the voltage at the panel C2 is increased to a voltage of Vs.

When the switch S1 is turned off and a switch S3 is turned on, zero voltage switching is performed and the voltage at the panel C2 is maintained at the voltage of +Vs because the voltage at the switch S3 is 0V.

When the switch S3 is turned off and a switch S2 is turned on, an LC resonance circuit is formed in the order of the panel C2, the inductor L1, a diode D2, the switch S2, and the capacitor C1, and the voltage at the panel C2 is reduced.

When the switch S2 is turned off and a switch S4 is turned on, zero voltage switching is performed and the voltage at the panel C2 is maintained at 0V because the voltage at the switch S4 is 0V.

The sustain discharge pulses are combined with the waveforms applied by the first ramp pulse supply 31, the second ramp pulse supply 32, and the scan voltage supply 33 to form various driving waveforms. In this instance, switches Ypp and Ynp on the main discharge path A are switched to supply various driving waveforms to the panel. The switches Ypp and Ynp need double path switches because an erase operation or a scan operation can be performed in a negative bias level.

However, the switches Ypp and Ynp formed on the main discharge path are causes to increase pattern impedance. That is, the pattern impedance formed on the main discharge path A formed between the electrode and the sustain discharge circuit distorts the waveforms and influences margins of the sustain voltage because of an overshot voltage.

FIGS. 5*a* and 5*b* show graphs for measuring influences of the pattern impedance of the main discharge path.

In consideration of the pattern impedance provided on the main discharge path as an inductance component, FIG. 5*a* shows a measured sustain discharge waveform without pattern impedance, and FIG. 5*b* shows a measured sustain discharge waveform with the pattern impedance of 0.01 μH.

As known from FIG. 5*b*, the time for the sustain discharge waveform to reach the steady state is delayed because of the pattern impedance formed on the main discharge path, and a large overshoot is generated. Therefore, the pattern impedance decreases the margin of the sustain discharge voltage and damages stability of the waveforms.

SUMMARY OF THE INVENTION

It may be an advantage of the present invention to provide an improved PDP driving circuit for minimizing the impedance provided on a main discharge path.

It may be another advantage of the present invention to provide a PDP driving circuit for minimizing pattern impedance by allowing no switches on the path provided between a sustain discharge circuit and a panel electrode.

In one aspect of the present invention, a driver for a PDP including discharge cells with a plurality of electrodes, comprises: a first voltage source having a first voltage level; a first active element for intercepting a current flow in the direction of the first voltage source; a first switch coupled between the first active element and an electrode; a capacitor for storing a second voltage; and a second switch for supplying the second voltage stored in the capacitor to the electrode.

The first active element and the first switch may be realized by a first transistor and a second transistor respectively, and the first and second transistors may be coupled with each other in a back-to-back manner.

A source of the first transistor may be coupled to the first voltage source, and drains of the first and second transistors may be coupled with each other in a back-to-back manner.

The drain of the first transistor may be coupled to the first voltage source, and sources of the first and second transistors may be coupled with each other in a back-to-back manner.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
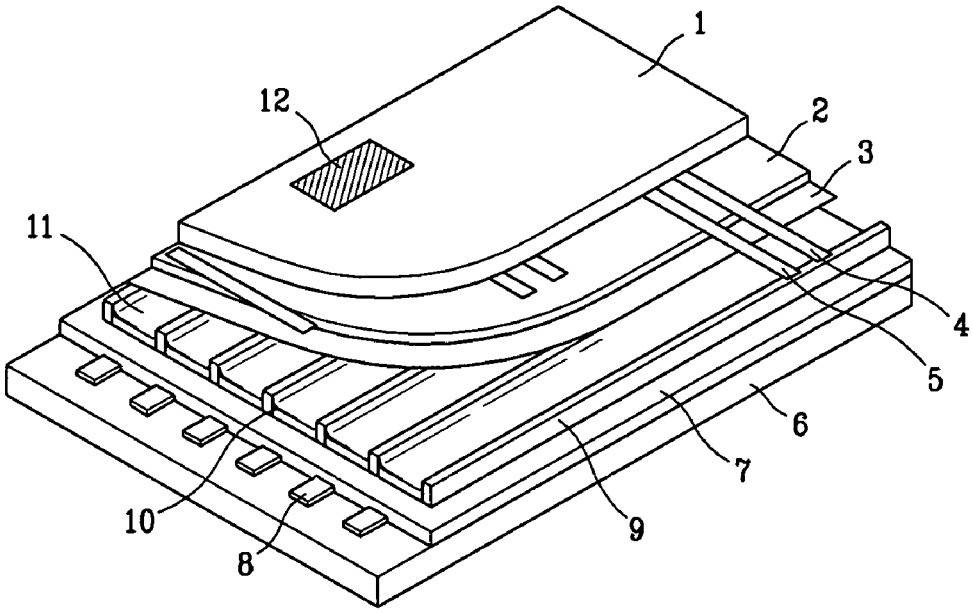
FIG. 1 (Prior Art)
FIG. 1 shows a perspective view of an AC PDP.
Figure 2:
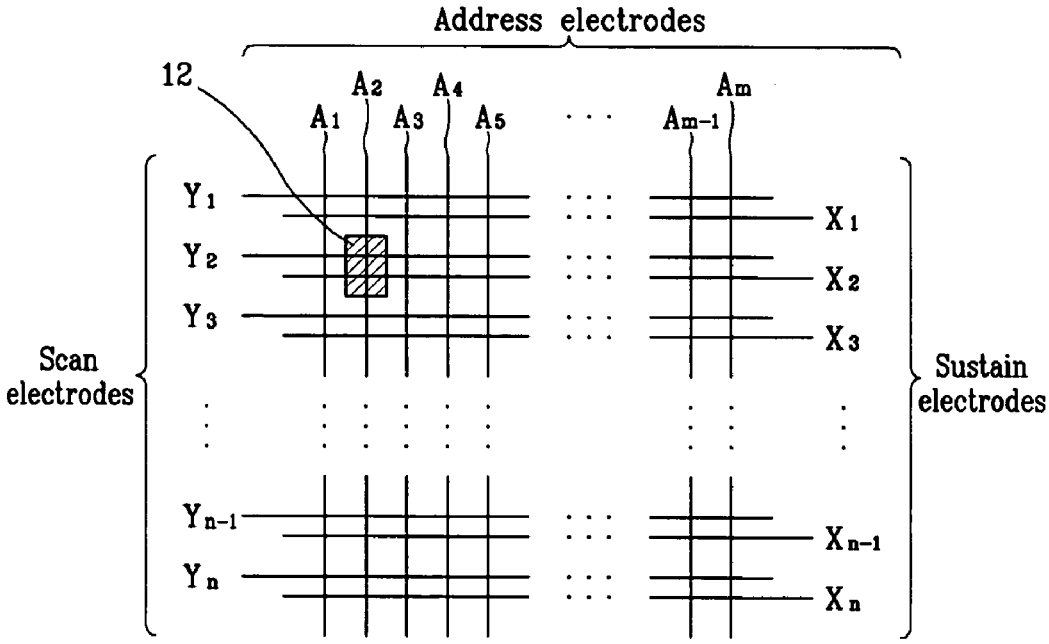
FIG. 2 (Prior Art)
FIG. 2 shows a PDP electrode arrangement diagram.
Figure 3:
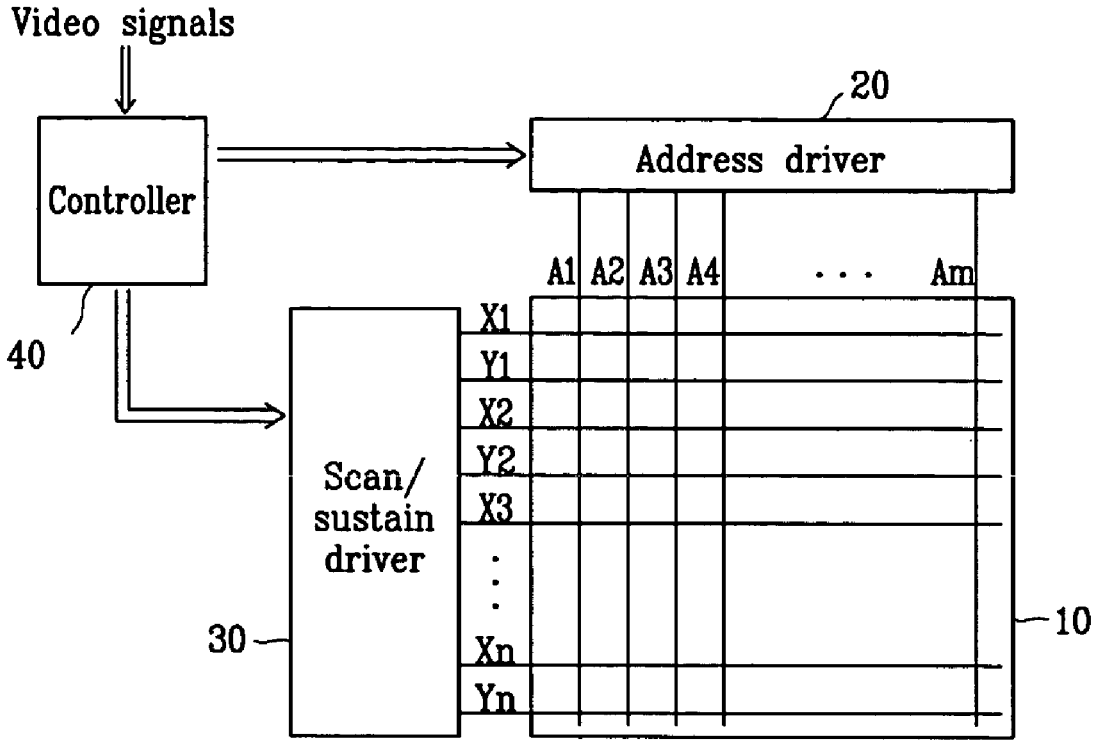
FIG.3(Prior Art)
FIG. 3 shows a PDP.

In the following detailed description, only the preferred embodiment of the invention has been shown and described, simply by way of illustration of the best mode contemplated. As will be realized, the invention may be capable of modification in various obvious respects, all without departing from the invention. Accordingly, the drawings and description should be regarded as illustrative in nature, and not restrictive. To clarify the present invention, parts which are not described in the specification are omitted, and parts for which similar descriptions are provided have the same reference numerals. Also, it should be noted that where one element or portion is coupled with another element or portion, the coupling not only includes a direct coupling between the elements or portions, but also includes an indirect coupling between the elements or portion via another element or portion.

A driving circuit according to an exemplary embodiment of the present invention will be described in detail.

Figure 6A:
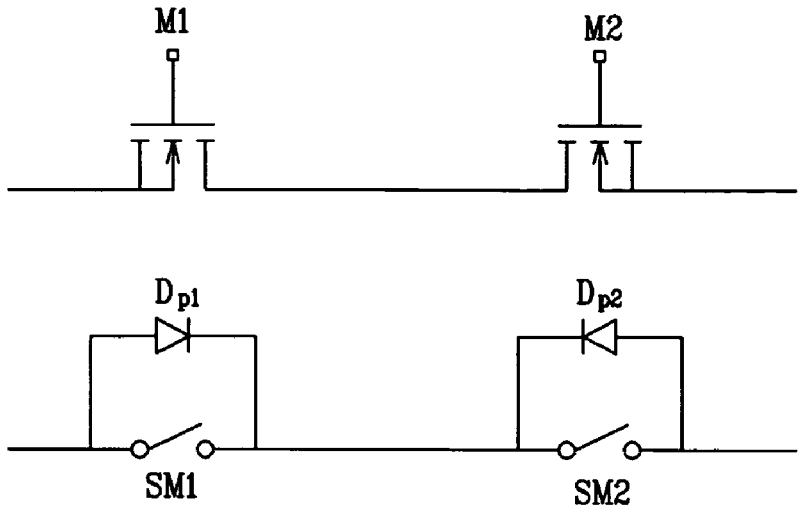
FIGS. 6*a* and 6*b* show circuit diagrams for describing back-to-back coupling used for an exemplary embodiment of the present invention.
Figure 6B:
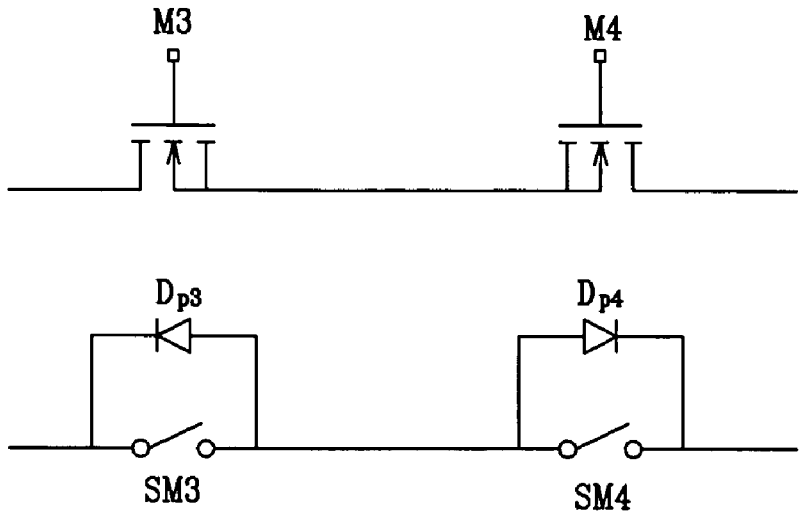

FIGS. 6*a* and 6*b* show circuit diagrams for describing back-to-back coupling used for an exemplary embodiment of the present invention.

FIGS. 6*a* and 6*b* show equivalent circuits corresponding to back-to-back coupling of transistors. As shown, the back-to-back coupled transistors configure body diodes Dp1, Dp2, Dp3, and Dp4, and driving signal switches SM1, SM2, SM3, and SM4 are switches according to gate driving signals of transistors M1, M2, M3, and M4.

For example, the current accordingly flows to the transistor M2 from the transistor M1 when no gate signal is applied to the transistor M1 and a gate signal is applied to the transistor M2.

Figure 7:
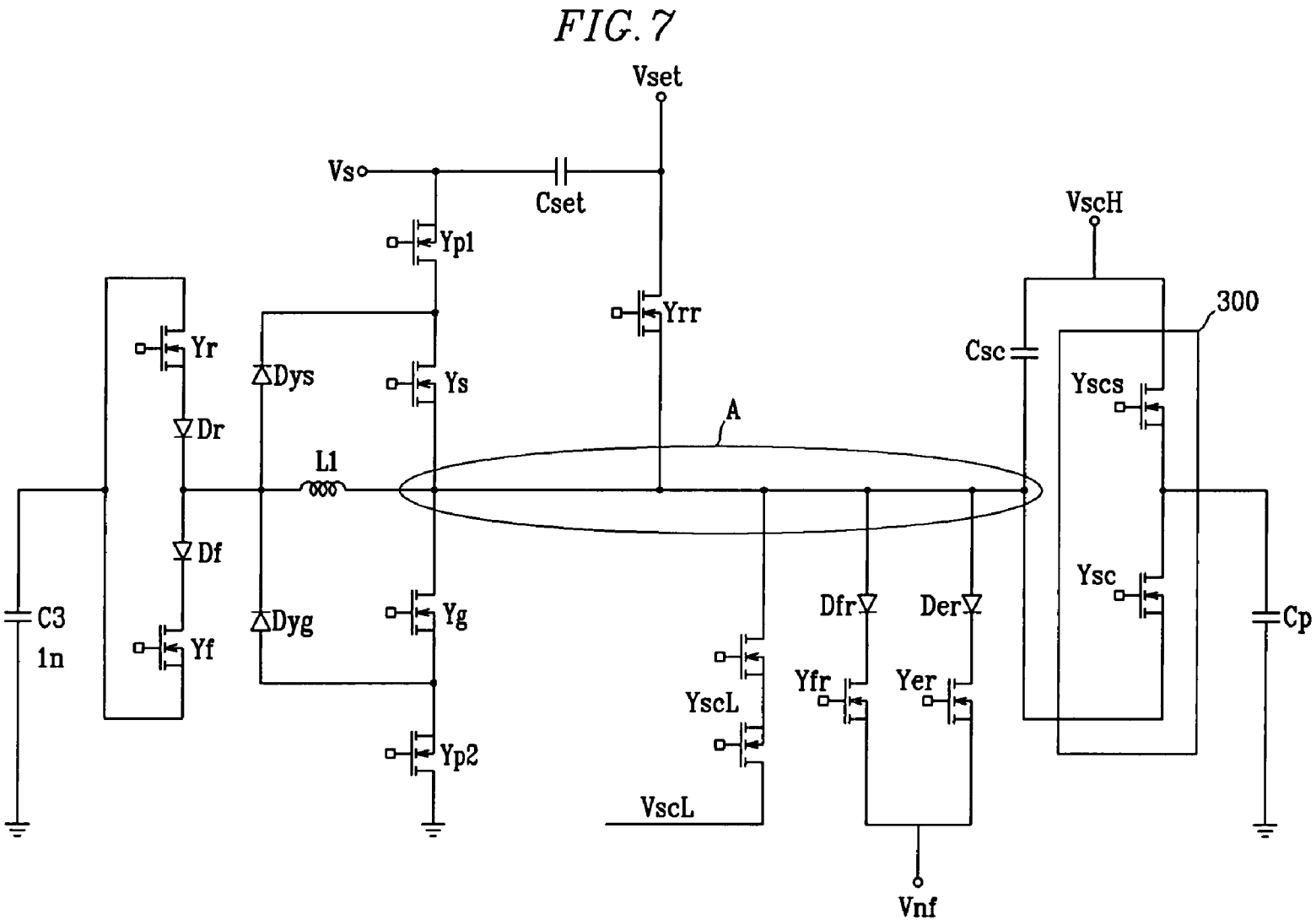
FIG. 7 shows a display panel driving circuit according to a first exemplary embodiment of the present invention.

FIG. 7 shows a display panel driving circuit according to a first exemplary embodiment of the present invention.

Figure 4:
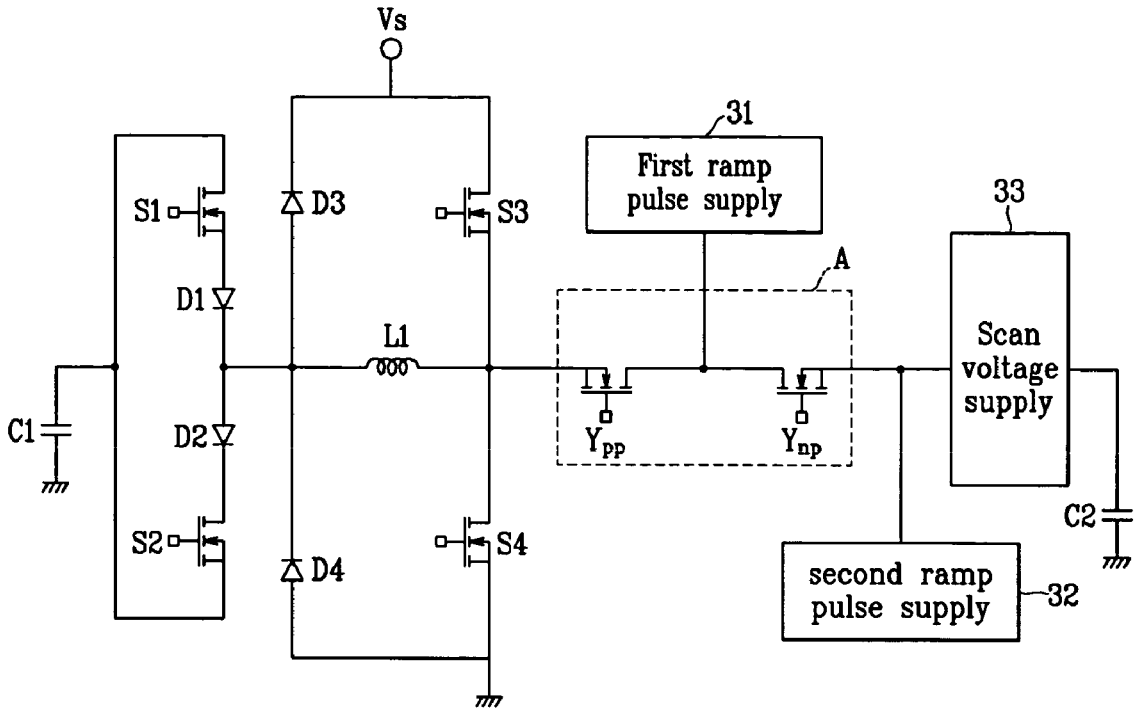
FIG. 4(Prior Art)
FIG. 4 shows a conventional PDP driving circuit.

As shown, the display panel driving circuit comprises a power recovery and sustain discharge circuit as shown in FIG. 4. The power recovery circuit comprises a capacitor C3, switches Yr and Yf, diodes Dr and Df, switches Ys and Yg, and a first voltage source Vs.

Also, a switch Yp1 may be coupled to the switch Ys in a back-to-back manner, and a switch Yp2 may be coupled to the switch Yg in a back-to-back manner. The switches Yp1 and Yp2 switches the main discharge path.

In addition to the sustain discharge circuit, a second voltage source Vset for supplying a rising ramp waveform may be coupled to the switch Yp1 through a capacitor Cset, and may be coupled to a transistor Yrr. A constant current driver (not illustrated) for allowing a driving voltage to ramp-rise can be coupled to the transistor Yrr.

Further, the first embodiment comprises a scan driver including voltage sources VscH and VscL, switches Yscs, Ysc, and YscL, and a capacitor Csc; a falling ramp driver including a diode Dfr and a transistor Yfr; and an erase driver including a diode Der and a transistor Yer. A constant current driver for allowing a driving waveform to ramp-fall can be coupled to gates of the transistors Yfr and Yer, though not illustrated. The scan driver, the falling ramp driver, and the erase driver can be realized by conventional circuits which perform the same operations, and the operations realized in the exemplary embodiment will be described later.

As known from FIG. 7, no switches may be provided on the main discharge path A provided between the sustain discharge circuit and the electrode, and hence, no pattern impedance according to the main discharge path may be generated in a like manner of the prior art.

Figure 8:
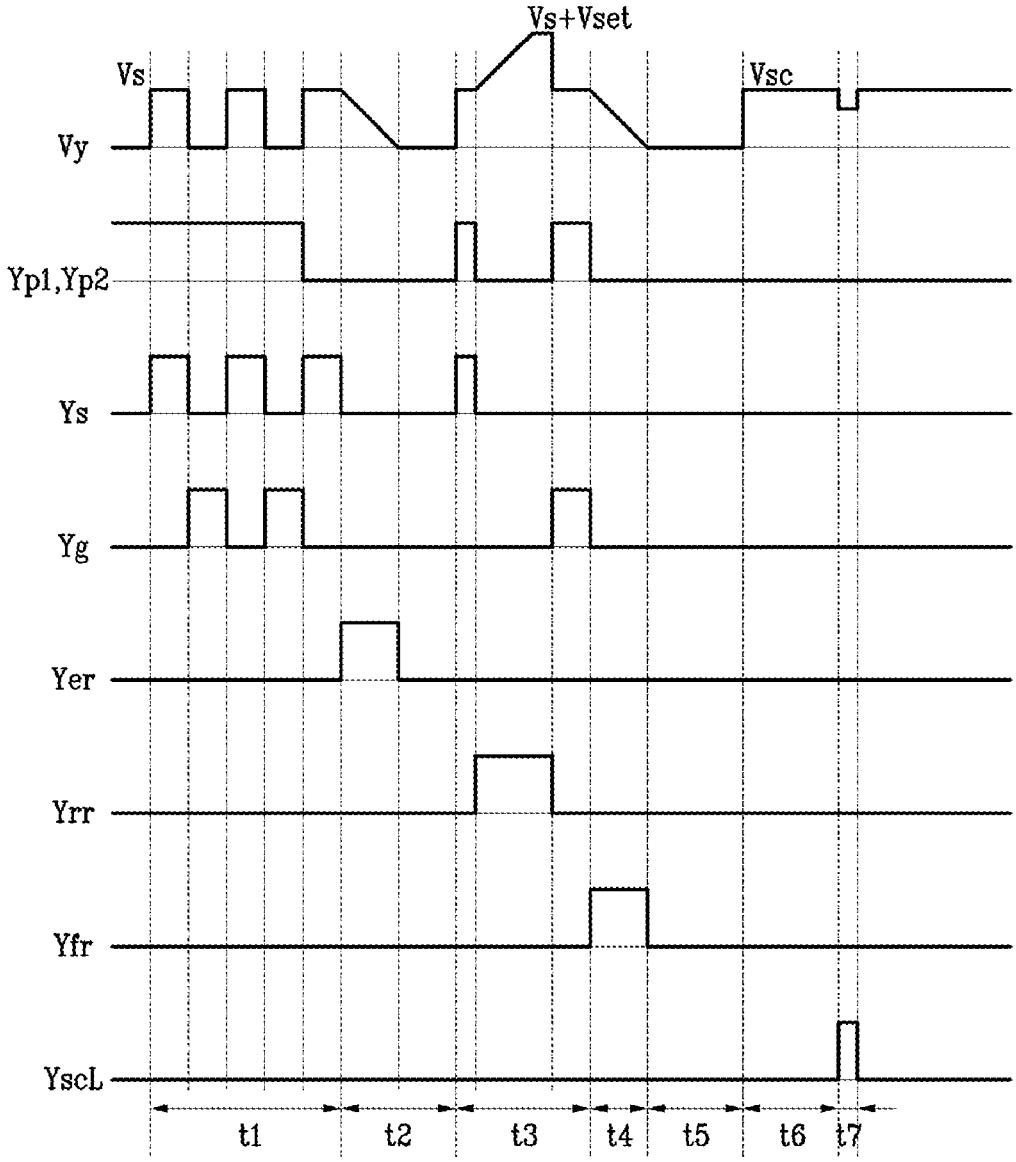
FIG. 8 shows a timing diagram of a driving waveform of a scan electrode and operations of respective switches according to an exemplary embodiment of the present invention.

FIG. 8 shows a timing diagram of a driving waveform of a scan electrode and operations of respective switches according to an exemplary embodiment of the present invention.

A PDP driving interval includes a sustain discharge period t1, an erase period t2, reset periods t3 and t4, and address periods t6 and t7.

A voltage of Vy represents a waveform of a voltage applied to the scan electrode. In the case of a sustain discharge operation, sustain discharge pulses with the voltage of Vs may be repeatedly applied during the sustain discharge period t1. Pulses with the opposite polarity can be applied to the sustain electrode while the pulses of the voltage of Vs for the sustain discharge may be applied to the scan electrode. The sustain discharge operation may be performed in a like manner to the operation of the power recovery circuit shown in FIG. 4.

During the erase period t2, the waveform at the scan electrode ramp-falls, and wall charges accumulated on the electrode may be erased. During the reset periods t3 and t4, the voltage of (Vs+Vset) for generating a strong discharge may be applied, the voltage may be controlled to gradually fall, and a reset operation for addressing may be performed. During the address periods t6 and t7, the panel to be discharged may be selected.

As shown in FIG. 8, the switches Ys and Yg may be sequentially switched to perform the sustain discharge operation while the switches Yp1 and Yp2 may be maintained to be turned on, which corresponds to the sustain discharge operation of the circuit of FIG. 4.

The constant current driver for driving the transistor Yer may be turned on, the sustain voltage of Vs ramp-falls, and the erase operation may be performed.

Figure 9:
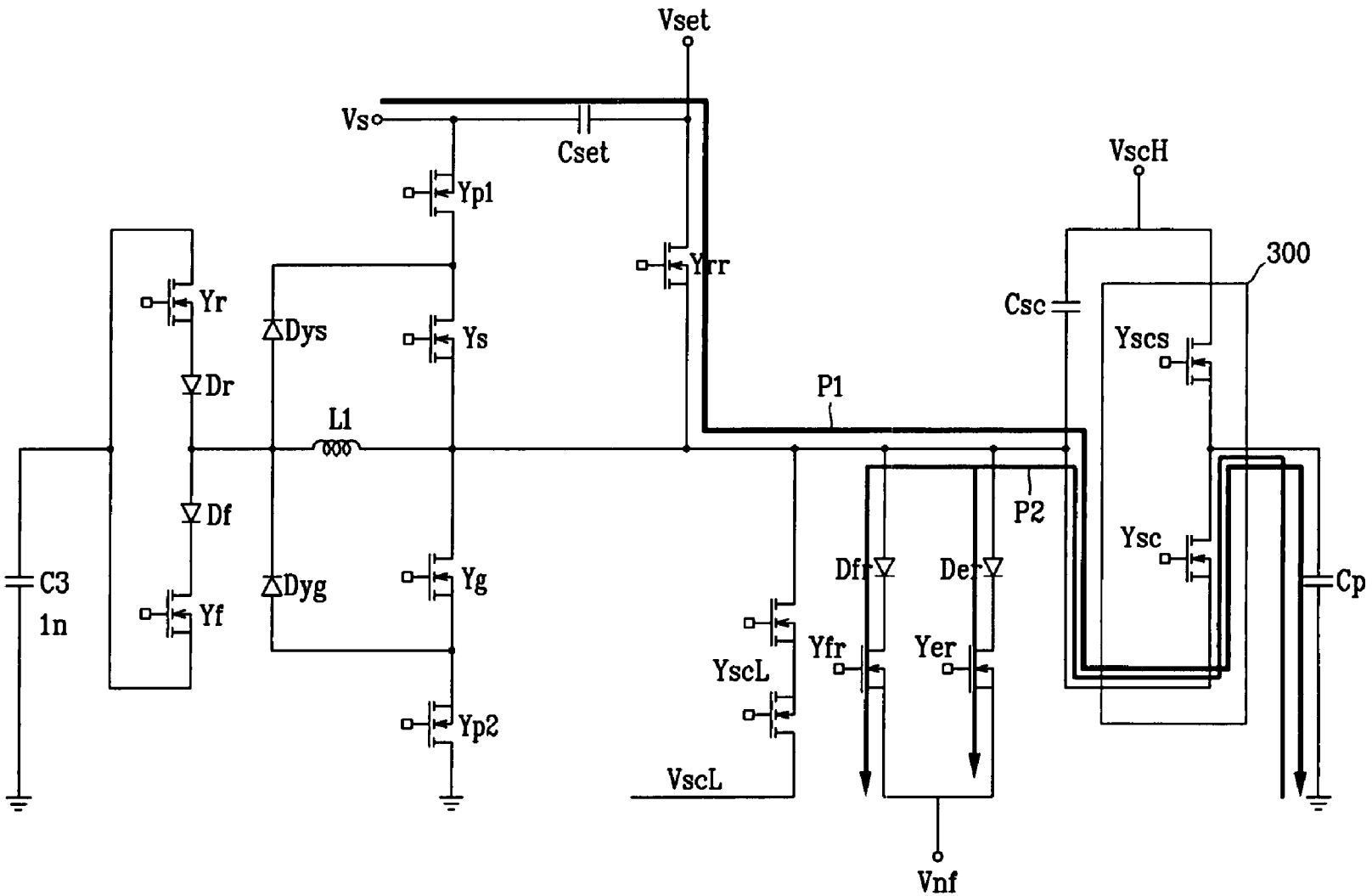
FIG. 9 shows a circuit diagram for a reset operation according to a first exemplary embodiment of the present invention.

FIG. 9 shows a circuit diagram for a reset operation according to a first exemplary embodiment of the present invention.

In the period t3, the switches Yp1, Yp2, and Ys may be instantly turned on and charged with the voltage of Vs for the purpose of ramp rising for the reset operation. A constant current driver for driving the transistor Yrr may be turned on to allow the waveform to ramp-rise by the voltage of (Vs+Vset). The transistor Yrr may be turned off and the switches Yp1, Yp2, and Yg may be turned on to reduce the voltage, and the constant current driver for driving the transistor Yfr may be turned on to allow the voltage to ramp-fall to a predetermined level.

Figure 10:
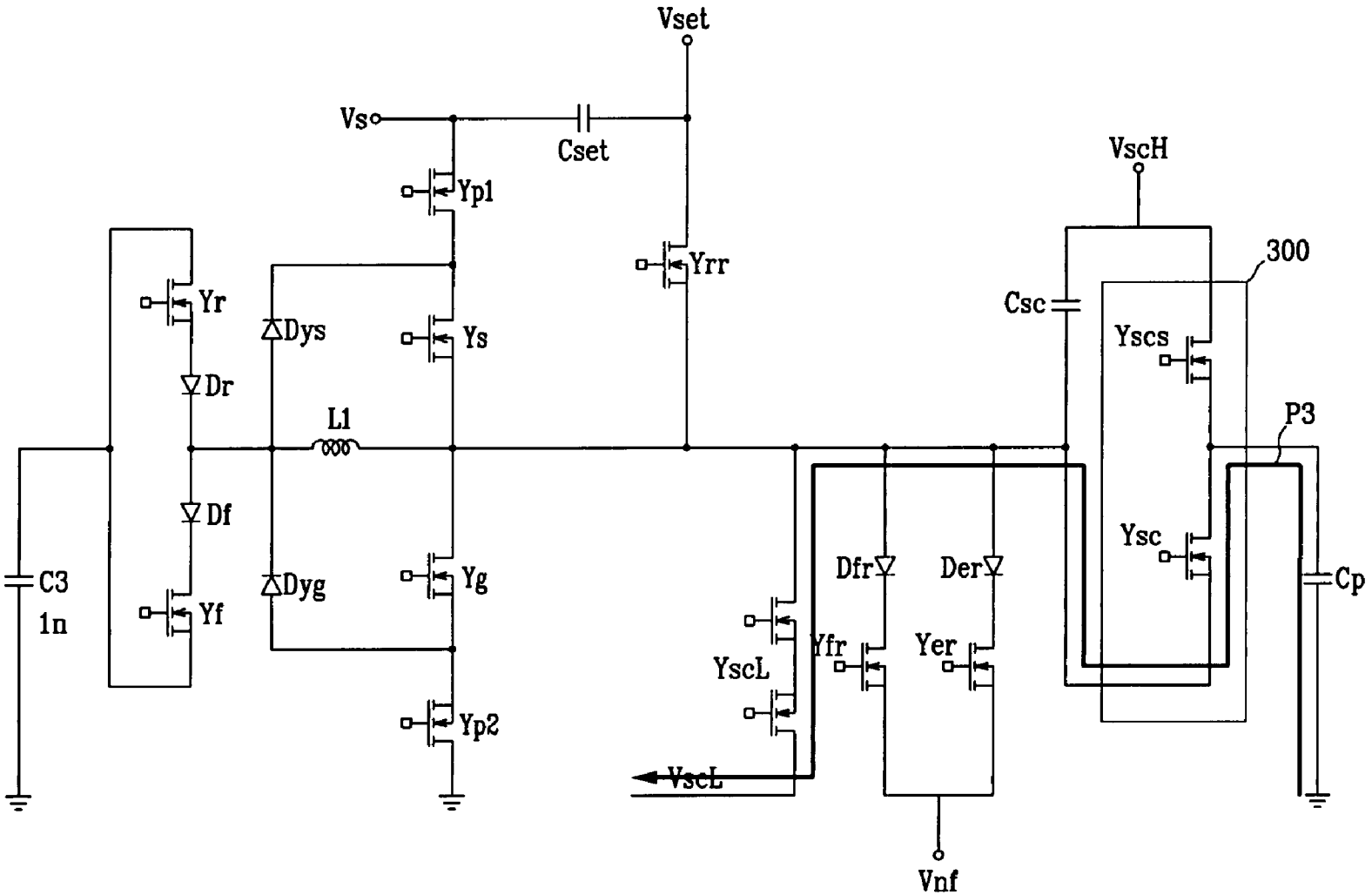
FIG. 10 shows a circuit diagram for an address operation according to a first exemplary embodiment of the present invention.

FIG. 10 shows a circuit diagram for describing an address operation according to a first exemplary embodiment of the present invention.

When the reset operation is finished, the pulse with the voltage of Vsc may be applied by the scan driving circuit 300, and the switch YscL may be turned on to instantly reduce the voltage level during the period t7. In this instance, an address voltage is applied to the address electrode to generate an address discharge during the period t7, which is not illustrated.

As described, the first embodiment allows performance of the sustain, erase, reset, and address operations for driving the panel without providing switches on the main discharge path A. Therefore, various waveforms for driving the PDP without generating the impedance component on the main discharge path may be generated.

Figure 11:
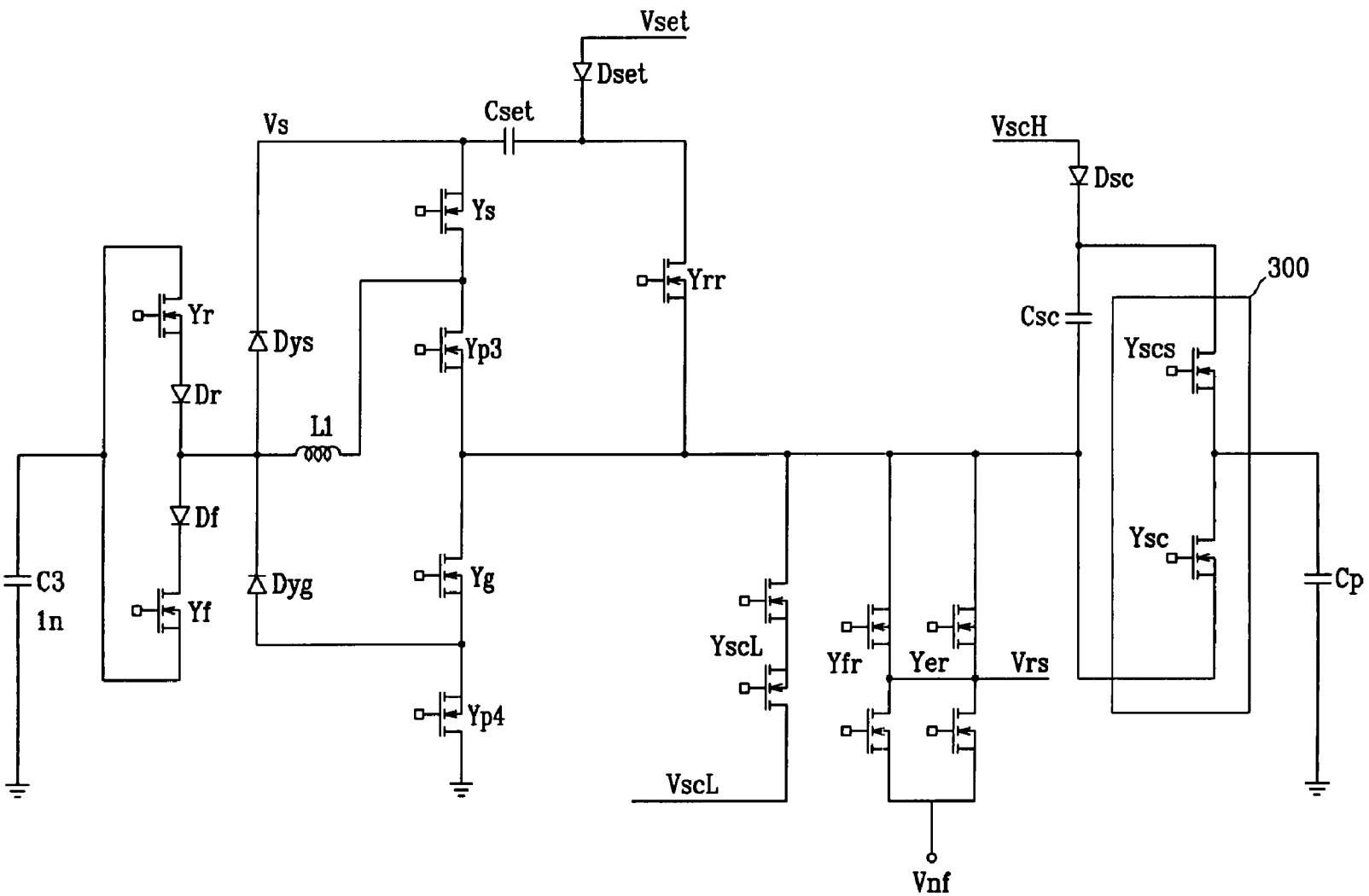
FIG. 11 shows a driving circuit according to a second exemplary embodiment of the present invention.

FIG. 11 shows a driving circuit according to a second exemplary embodiment of the present invention.

Compared to the first embodiment, the position of the switch for applying the sustain discharge voltage may be exchanged with that of the pattern switch Yp3 and back-to-back coupled thereto in the second embodiment. Therefore, the current through the inductor L1 may be supplied to the electrode through the switch Yp3.

The second embodiment may perform the sustain discharge, erase, reset, and address operations according to the timing diagram shown in FIG. 8. Hence, no additional detailed descriptions on the operations is necessary.

However, the switch Yp3 may be arranged between the power recovery circuit and the electrode to reduce the withstanding voltage of the power recovery circuit during rising ramp operation in the reset period in the second embodiment.

Figure 12A:
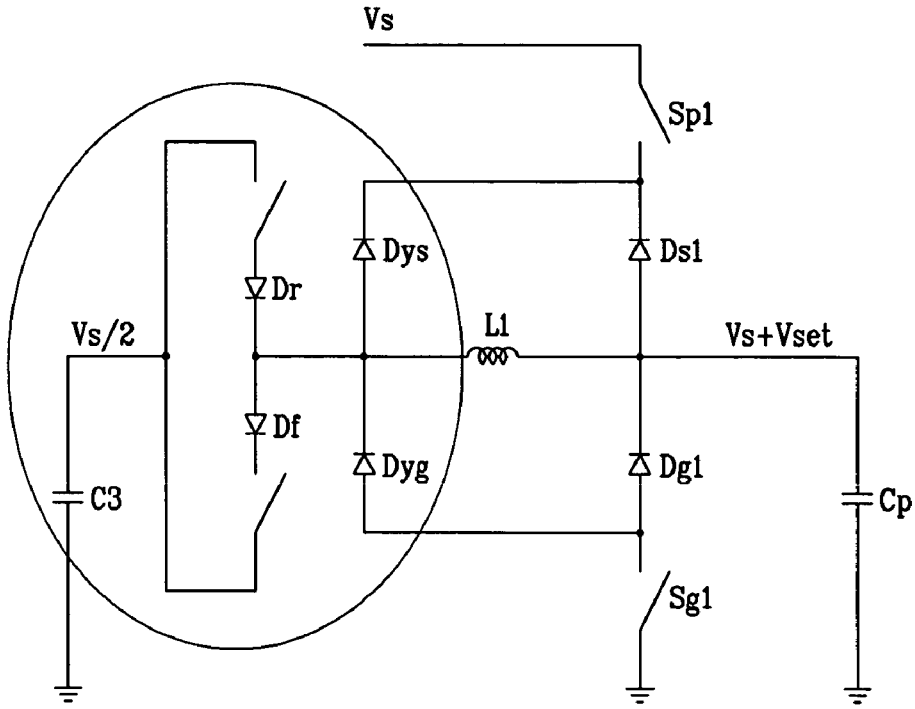
FIGS. 12*a* and 12*b* show equivalent circuits of the first and second exemplary embodiments of the present invention in the case of ramp rising.
Figure 12B:
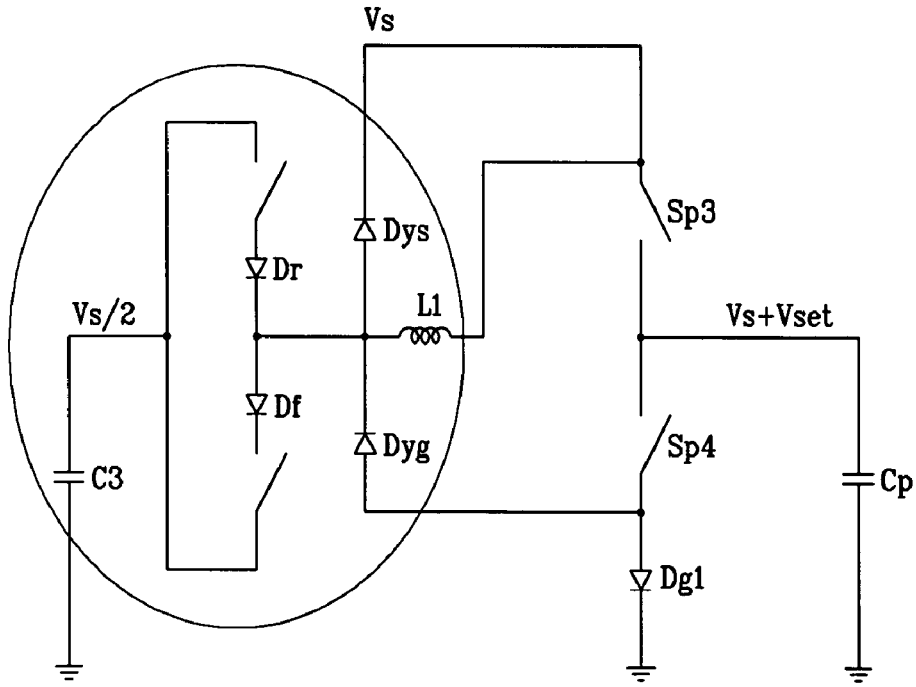

FIGS. 12*a* and 12*b* show equivalent circuits of the first and second exemplary embodiments of the present invention in the case of ramp rising.

Figure 5A:
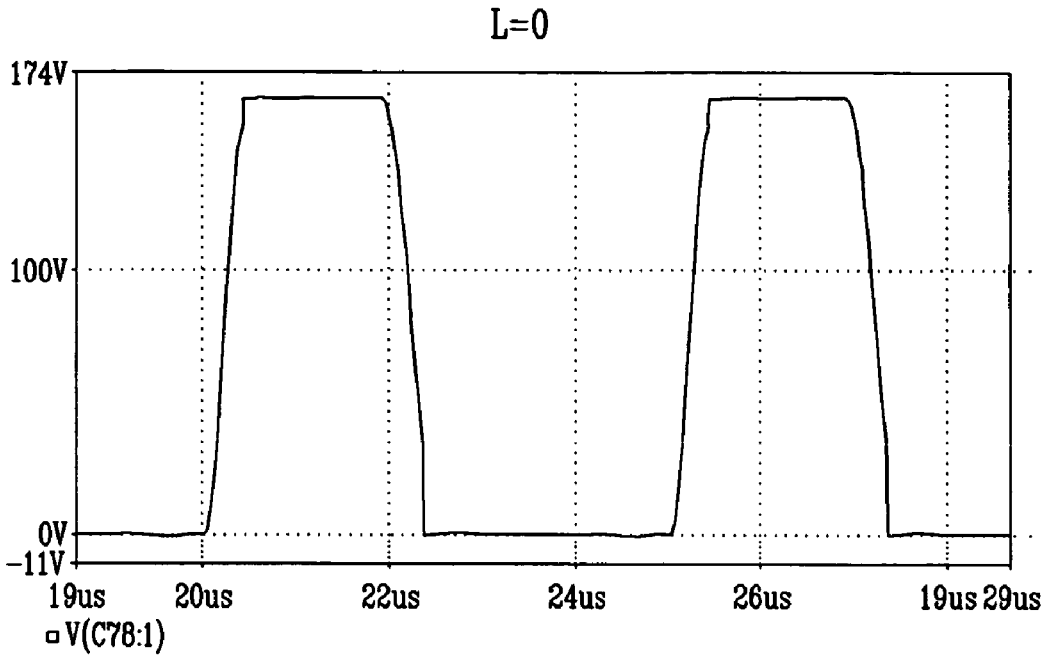
FIG.5A(Prior Art)
FIGS. 5*a* and 5*b* show graphs for measuring influences of the pattern impedance of the main discharge path.
Figure 5B:
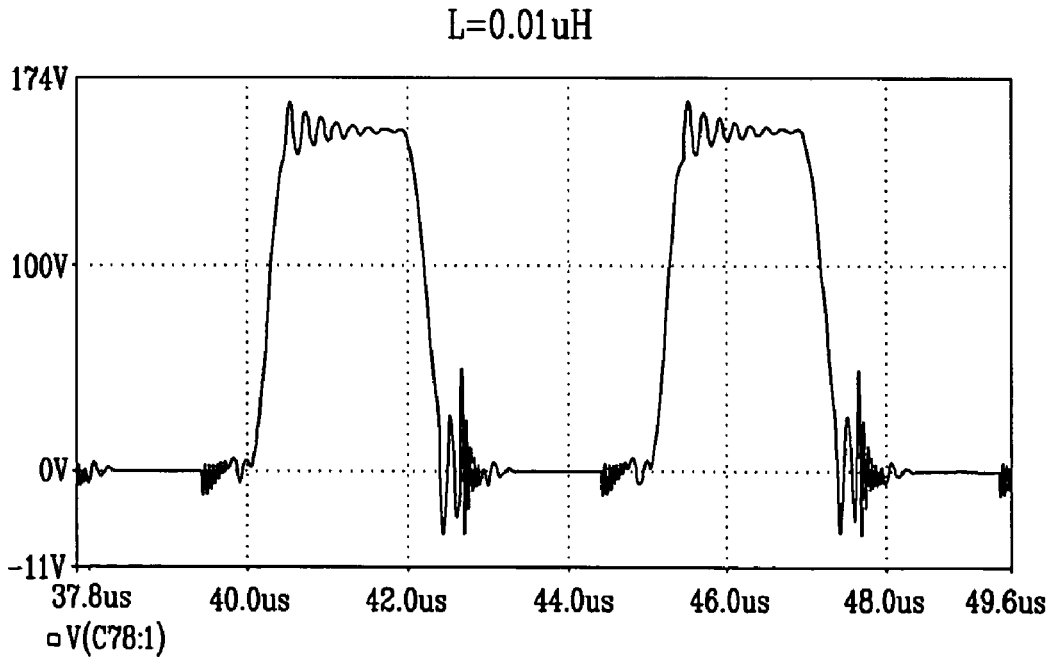
FIG.5B(Prior Art)

As shown in FIG. 12*a*, in the first embodiment, the voltage of (Vs+Vset) may be applied to the power recovery circuit. The switches Yp1, Yp2, Ys, and Yg may be turned off in the case of ramp rising, but the voltage of (Vs+Vset) may be applied to the power recovery circuit depicted by a circle by a body diode which occurs at the back-to-back coupling shown in FIGS. 5*a* and 5*b*. Thus the withstanding voltage may be increased.

As shown in FIG. 12*b*, in the second embodiment, when the positions of the switches Ys and Yp3 have been exchanged, the switches Yp3 and Yp4 may be turned off and the voltage of (Vs+Vset) is blocked by the power recovery circuit in the case of ramp rising. Hence, the withstanding voltage on the elements of the power recovery circuit may be reduced.

The first and second embodiments increase the withstanding voltages of the switches Ys and Yg for performing the sustain operation compared to the prior art, and may also effectively eliminate bad influences of the pattern impedance with less cost. This may be because a lot of IGBT elements for high withstanding voltages have been developed and the costs may be decreasing, although this will depend on IGBT development.

While this invention has been described in terms of preferred embodiments, it should be understood that the invention is not limited to the disclosed embodiments. On the contrary, is includes various modifications and equivalent arrangements included within the spirit and scope of the appended claims.

As described above, the impedance component generated on the main discharge path of the PDP driving circuit may be eliminated, the discharge margins may be increased, and distortions of waveforms may be prevented, thereby allowing stable discharge operations.

What is claimed is:

1. A driver for a plasma display panel including discharge cells with a plurality of electrodes, comprising:

a first voltage source having a first voltage level;

a first switch coupled between the first voltage source and an electrode;

a first active element for cutting off a current flowing in the direction of the first voltage source through the first switch;

a capacitor for storing a second voltage; and a second switch coupled between the capacitor and the electrode, and for turning on in a reset period to supply the second voltage stored in the capacitor to the electrode, wherein the first voltage source, the first switch, the first active element, and the electrode form a first current path, and wherein the first voltage source, the capacitor, the second switch, and the electrode form a second current path, and the first switch and the first active element are not on the second current path.

2. The driver of claim 1, wherein the first active element and the first switch comprise a first transistor and a second transistor respectively, and the first and second transistors are coupled together, back-to-back.

3. The driver of claim 2, wherein a source of the first transistor is coupled to the first voltage source, and drains of the first and second transistors are coupled together, back-to-back.

4. The driver of claim 2, wherein the drain of the first transistor is coupled to the first voltage source, and sources of the first and second transistors are coupled together, back-to-back.

5. The driver of claim 3, further comprising a constant current driver for controlling the constant current to flow to the second switch.

6. The driver of claim 4, further comprising a constant current driver for controlling the constant current to flow to the second switch.

7. The driver of claim 3, further comprising:

a third voltage source having a voltage level lower than that of the first voltage;

a third switch coupled between the electrode and the third voltage source; and a second active element coupled between the third switch and the third voltage source, for cutting off a current flowing in the direction of the third voltage source through the third switch.

8. The driver of claim 4, further comprising:

a third voltage source having a voltage level lower than that of the first voltage;

a third switch coupled between the electrode and the third voltage source; and a second active element coupled between the third switch and the third voltage source, for cutting off a current flowing in the direction of the third voltage source through the third switch.

9. The driver of claim 7, wherein the second active element and the third switch comprise transistors, and are coupled together, back-to-back.

10. The driver of claim 8, wherein the second active element and the third switch comprise transistors, and are coupled together, back-to-back.

11. The driver of claim 1, further comprising a falling ramp driver for downwardly ramping the voltage applied to the electrode.

12. The driver of claim 7, wherein the first and third switches comprise IGBT elements.

13. The driver of claim 8, wherein the first and third switches comprise IGBT elements.

14. A plasma display device comprising:

a plasma display panel having discharge cells formed between a sustain electrode, a scan electrode, and an address electrode; and a driving circuit for applying driving voltages to the sustain electrode, the scan electrode, and the address electrode during a reset period, an address period, and a sustain period, wherein the driving circuit comprises:

a first voltage source having a first voltage level;

a first switch coupled between the first voltage source and an electrode;

a first active element for cutting off a current flowing in the direction of the first voltage source through the first switch;

a capacitor for storing a second voltage; and a second switch coupled between the capacitor and the electrode, and for turning on in a reset period to supply the second voltage stored in the capacitor to the electrode, wherein the first voltage source, the first switch, the first active element, and the electrode form a first current path, and wherein the first voltage source, the capacitor, the second switch, and the electrode form a second current path, and the first switch and the first active element are not on the second current path.

15. The plasma display device of claim 14, wherein the first active element and the first switch comprise a first transistor and a second transistor respectively, and the first and second transistors are coupled together, back-to-back.

16. The plasma display device of claim 14, wherein the driving circuit further comprises:

a third voltage source having a voltage level lower than that of the first voltage;

a third switch coupled between the electrode and the third voltage source; and a second active element coupled between the third switch and the third voltage source, for cutting off a current flowing in the direction of the third voltage source through the third switch.

17. A driver for a plasma display panel including discharge cells with a plurality of electrodes, comprising:

a first voltage source having a first voltage level;

a first switch coupled between the first voltage source and an electrode;

a first active element for cutting off a current flowing in the direction of the first voltage source through the first switch;

a capacitor for storing a second voltage from a second voltage source;

a second switch coupled between the capacitor and the electrode, and for turning on in a reset period to supply the second voltage stored in the capacitor to the electrode;

a third voltage source having a voltage level lower than that of the first voltage;

a third switch coupled between the electrode and the third voltage source; and a second active element, coupled between the third switch and the third voltage source, for cutting off a current flowing in the direction of the third voltage source through the third switch, wherein the first switch and the third switch are alternately turned on and off during a sustain period.

18. The driver of claim 17, wherein the first active element and the first switch comprise a first transistor and a second transistor respectively, and the first and second transistors are coupled together, back-to-back.

19. The driver of claim 18, wherein a source of the second transistor is coupled to the first voltage source, and drains of the first and second transistors are coupled together, back-to-back.

20. The driver of claim 17, wherein the first active element and the second active element remain on while the first switch and the third switch are alternately turned on and off.

* * * * *